US007279455B2

(12) United States Patent
Kieffer et al.

(10) Patent No.: US 7,279,455 B2
(45) Date of Patent: Oct. 9, 2007

(54) RINSE AID COMPOSITION AND METHOD OF RISING A SUBSTRATE

(75) Inventors: Janel Marie Kieffer, Hastings, MN (US); Steven Eugene Lentsch, St. Paul, MN (US); Eddie D. Sowle, Woodbury, MN (US); Jessica Susan Hammerberg, Rosemount, MN (US)

(73) Assignee: Ecolab, Inc., St. Paul, MN (US)

( * ) Notice: Subject to any disclaimer, the term of this patent is extended or adjusted under 35 U.S.C. 154(b) by 278 days.

(21) Appl. No.: 10/703,042

(22) Filed: Nov. 6, 2003

(65) Prior Publication Data

US 2005/0101516 A1 May 12, 2005

(51) Int. Cl.

| | |
|---|---|
| ***C11D 1/72*** | (2006.01) |
| ***C11D 1/722*** | (2006.01) |
| ***C11D 3/37*** | (2006.01) |
| ***B08B 3/04*** | (2006.01) |

(52) U.S. Cl. ..... 510/524; 510/220; 510/413; 510/421; 510/475; 510/505; 134/25.2; 134/25.3; 134/39; 134/40; 134/42

(58) Field of Classification Search ..... 510/220, 510/413, 421, 475, 505, 524; 134/25.2, 25.3, 134/39, 40, 42

See application file for complete search history.

(56) References Cited

U.S. PATENT DOCUMENTS

| | | | | |
|---|---|---|---|---|
| 4,426,362 | A | 1/1984 | Copeland et al. | |
| 4,492,646 | A | 1/1985 | Welch | |
| 4,618,914 | A | 10/1986 | Sato et al. | |
| 4,647,258 | A | 3/1987 | Massarsch | |
| 4,654,161 | A | 3/1987 | Kollmeier et al. | |
| 4,687,121 | A | 8/1987 | Copeland | |
| 4,690,305 | A | 9/1987 | Copeland | |
| RE32,763 | E | 10/1988 | Fernholtz et al. | |
| RE32,818 | E | 1/1989 | Fernholtz et al. | |
| 4,826,661 | A | 5/1989 | Copeland et al. | |
| 4,830,773 | A | 5/1989 | Olson | |
| 5,273,677 | A | 12/1993 | Arif | |
| 5,589,099 | A | 12/1996 | Baum | |
| 5,603,776 | A | 2/1997 | Lentsch et al. | |
| 5,674,831 | A | 10/1997 | Schulz et al. | |
| 5,880,088 | A | 3/1999 | Lentsch et al. | |
| 5,880,089 | A | 3/1999 | Lentsch et al. | |
| H1818 | H | 11/1999 | Potgieter et al. | |
| 6,258,765 | B1 | 7/2001 | Wei et al. | |
| 6,294,515 | B1 | 9/2001 | Baum | |
| 6,530,383 | B1 * | 3/2003 | Rogmann et al. | 134/25.2 |
| 6,537,961 | B1 | 3/2003 | Koch | |

FOREIGN PATENT DOCUMENTS

| | | | |
|---|---|---|---|
| WO | 89/11525 | * | 11/1989 |
| WO | WO89/11525 | | 11/1989 |
| WO | WO 00/46327 | * | 8/2000 |
| WO | 01/83879 | * | 11/2001 |
| WO | WO 01/83879 A1 | | 11/2001 |

OTHER PUBLICATIONS

BASF brochure entitled "Pluronic & Tetronic Block Copolymer Surfactants", no date given.

* cited by examiner

*Primary Examiner*—Brian Mruk
(74) *Attorney, Agent, or Firm*—Kinney & Lange, P.A.

(57) ABSTRACT

A rinse aid composition and methods of making and using the same. A rinse aid composition may generally include an effective amount of a sheeting agent component, and an effective amount of a defoamer component. The sheeting agent component may include one or more alcohol ethoxylate compounds that include an alkyl group that includes 12 or fewer carbon atoms. The defoamer component may include an ethylene oxide containing surfactant configured for reducing the stability of foam that may be created by the one or more alcohol ethoxylate compounds of the sheeting agent in an aqueous solution.

43 Claims, No Drawings

RINSE AID COMPOSITION AND METHOD OF RISING A SUBSTRATE

FIELD OF THE INVENTION

The invention relates to a rinse aid composition, and methods for manufacturing and using the rinse aid composition. The rinse aid composition generally includes a sheeting agent component including one or more alcohol ethoxylates and a defoamer component. The rinse aid can be used in aqueous solutions on articles including, for example, cookware, dishware, flatware, glasses, cups, hard surfaces, glass surfaces, vehicle surfaces, etc.

BACKGROUND

Mechanical warewashing machines including dishwashers have been common in the institutional and household environments for many years. Such automatic warewashing machines clean dishes using two or more cycles which can include initially a wash cycle followed by a rinse cycle. Such automatic warewashing machines can also utilize other cycles, for example, a soak cycle, a pre-wash cycle, a scrape cycle, additional wash cycles, additional rinse cycles, a sanitizing cycle, and/or a drying cycle. Any of these cycles can be repeated, if desired, and additional cycles can be used. Rinse aids are conventionally used in warewashing applications to promote drying and to prevent the formation of spots.

In order to reduce the formation of spotting, rinse aids have commonly been added to water to form an aqueous rinse that is sprayed on the dishware after cleaning is complete. The precise mechanism through which rinse agents work is not established. One theory holds that the surfactant in the rinse agent is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and/or do not exhibit a cloud point, and, according to this theory, would not promote sheet formation, thereby resulting in spots. Moreover, high foaming materials are known to interfere with the operation of warewashing machines.

In some cases, defoaming agents have been used in an attempt to promote the use of high foaming surfactants in rinse aids. In theory, the defoaming agents may include surfactants with a cloud point at or below the temperature of the rinse water, and would thereby precipitate out and modify the air/liquid interface and destabilize the presence of foam that may be created by the high foaming surfactants in the rinse water. However, in many cases, it has been difficult to provide suitable combinations of high foaming surfactants and defoamers to achieve desired results. For example, for certain high foaming surfactants, it has often been necessary to provide defoaming agents that are chemically quite complicated. For example, Published International Patent Application No. WO89/11525 discloses an ethoxylate defoamer agent that is capped with an alkyl residue. Additionally, there are often concerns regarding providing rinse aids that are environmentally friendly, and that include components that are suitable for use in food service industries.

A number of rinse aids are currently known, each having certain advantages and disadvantages. There is an ongoing need for alternative rinse aid compositions.

BRIEF SUMMARY OF SOME EMBODIMENTS

The invention pertains to rinse aid compositions and methods of making and using rinse aid compositions. The rise aid composition can be referred to more simply as the rinse aid. In at least some embodiments, the rinse aid may generally include a sheeting agent component comprising one or more alcohol ethoxylates that include an alkyl group that includes 12 or fewer carbon atoms. For example, in some embodiments, the rinse aid can include a sheeting agent component including one or more alcohol ethoxylates having the general formula:

$$R—O—(CH_2CH_2O)_n—H$$

wherein R is a ($C_1$-$C_{12}$) alkyl group, and n is an integer in the range of 1 to 100. In some embodiments, the sheeting agent component can include a first alcohol ethoxylate and a second alcohol ethoxylate different from the first alcohol ethoxylate, the first and second alcohol ethoxylate different from the first alcohol ethoxylate, the first and second alcohol ethoxylates each independently having structure represented by the above formula. The rinse aid can also include an effective amount of a defoamer component configured for reducing the stability of foam that may be created by the alcohol ethoxylate in an aqueous solution. As discussed in more detail below, it has been discovered that such alcohol ethoxylates that include an alkyl group that includes 12 or few carbon atoms, can be effectively defoamed using simple defoamer agents, for example, ethylene oxide derivative defoamers.

Some example methods for making the rinse aid generally include the steps of combining the sheeting component and the defoamer, and, if desired, any other suitable additives so as to produce the rinse aid. These steps may generally include admixing, and in some embodiments where a solid product is formed, may include casting, extruding, or the like.

The rinse aid can be provided as a concentrate or as a use solution. In addition, the rinse aid concentrate can be provided in a solid form or in a liquid form. In general, it is expected that the concentrate will be diluted with water to provide the use solution that is then supplied to the surface of a substrate. The use solution preferably contains an effective amount of active material to provide reduced water solids filming in rinse water. It should be appreciated that the term "active materials" refers to the nonaqueous portion of the use solution that functions to reduce spotting and water solids filming.

Some example methods for using the rinse aid generally include the step of providing the rinse aid, mixing the rinse aid into an aqueous use solution, and applying the aqueous use solution to a substrate surface.

The above summary of some embodiments is not intended to describe each disclosed embodiment or every implementation of the present invention. The Detailed Description of Some Example Embodiments which follows more particularly exemplify some of these embodiments. While the invention is amenable to various modifications and alternative forms, specifics thereof will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, wt %, wt-%, % by weight, and the like are synonyms that refer to the concentration of a substance as the weight of that substance divided by the weight of the composition and multiplied by 100.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The "cloud point" of a surfactant rinse or sheeting agent is defined as the temperature at which a 1 wt. % aqueous solution of the surfactant turns cloudy when warmed.

As used herein, the term "alkyl" refers to a straight or branched chain monovalent hydrocarbon radical optionally containing one or more heteroatomic substitutions independently selected from S, O, Si, or N. Alkyl groups generally include those with one to twenty atoms. Alkyl groups may be unsubstituted or substituted with those substituents that do not interfere with the specified function of the composition. Substituents include alkoxy, hydroxy, mercapto, amino, alkyl substituted amino, or halo, for example. Examples of "alkyl" as used herein include, but are not limited to, methyl, ethyl, n-propyl, n-butyl, n-pentyl, isobutyl, and isopropyl, and the like. In addition, "alkyl" may include "alylenes", "alkenylenes", or "alkylynes".

As used herein, the term "alkylene" refers to a straight or branched chain divalent hydrocarbon radical optionally containing one or more heteroatomic substitutions independently selected from S, O, Si, or N. Alkylene groups generally include those with one to twenty atoms. Alkylene groups may be unsubstituted or substituted with those substituents that do not interfere with the specified function of the composition. Substituents include alkoxy, hydroxy, mercapto, amino, alkyl substituted amino, or halo, for example. Examples of "alkylene" as used herein include, but are not limited to, methylene, ethylene, propane-1,3-diyl, propane-1,2-diyl and the like.

As used herein, the term "alkenylene" refers to a straight or branched chain divalent hydrocarbon radical having one or more carbon-carbon double bonds and optionally containing one or more heteroatomic substitutions independently selected from S, O, Si, or N. Alkenylene groups generally include those with one to twenty atoms. Alkenylene groups may be unsubstituted or substituted with those substituents that do not interfere with the specified function of the composition. Substituents include alkoxy, hydroxy, mercapto, amino, alkyl substituted amino, or halo, for example. Examples of "alkenylene" as used herein include, but are not limited to, ethene-1,2-diyl, propene-1,3-diyl, and the like.

As used herein, the term "alkylyne" refers to a straight or branched chain divalent hydrocarbon radical having one or more carbon-carbon triple bonds and optionally containing one or more heteroatomic substitutions independently selected from S, O, Si, or N. Alkylyne groups generally include those with one to twenty atoms. Alkylyne groups may be unsubstituted or substituted with those substituents that do not interfere with the specified function of the composition. Substituents include alkoxy, hydroxy, mercapto, amino, alkyl substituted amino, or halo, for example.

As used herein, the term "alkoxy", refers to —O-alkyl groups wherein alkyl is as defined above.

As used herein, the term "halogen" or "halo" shall include iodine, bromine, chlorine and fluorine.

As used herein, the terms "mercapto" and "sulfhydryl" refer to the substituent —SH.

As used herein, the term "hydroxy" refers to the substituent —OH.

A used herein, the term "amino" refers to the substituent $—NH_2$.

DETAILED DESCRIPTION OF SOME EXAMPLE EMBODIMENTS

As discussed briefly above, rinse aid compositions in accordance with at least some embodiments may generally include a sheeting agent component comprising one or more alcohol ethoxylates that include an alkyl group that includes 12 or fewer carbon atoms, and an effective amount of a defoamer component configured for reducing the stability of foam that may be created by the alcohol ethoxylate sheeting agent component in an aqueous solution. In at least some embodiments, it has been discovered that such alcohol ethoxylates, when used as sheeting agents, can be defoamed using a variety of defoaming agents, for example, simple ethylene oxide containing defoaming agents. As discussed above, it has been difficult to provide rinse aid compositions that include suitable combinations of high foaming surfactants and defoamers to achieve desired results. Certain advantages have been discovered through the use of alcohol ethoxylates having an alkyl group that includes 12 or fewer carbon atoms as a sheeting agent. For example, defoaming agents having quite simple chemistry can be used to defoam such alcohol ethoxylates. For another example, the use of such alcohol ethoxylates as a sheeting agent provides additional options for formulating rinse aids that are environmentally friendly, and that include components that are suitable for use in food service industries.

Sheeting Component

The rinse aid may generally include an effective amount of a sheeting agent component comprising one or more alcohol ethoxylate compounds that include an alkyl group that has 12 or fewer carbon atoms. In at least some embodiments, alcohol ethoxylate compounds may each independently have structure represented by Formula I:

$$R—O—(CH_2CH_2O)_n—H \quad (I)$$

wherein R is a $(C_1\text{-}C_{12})$alkyl group and n is an integer in the range of 1 to 100. In some embodiments, R may be a $(C_8\text{-}C_{12})$alkyl group, or may be a $(C_8\text{-}C_{10})$alkyl group. Similarly, in some embodiments, n is an integer in the range of 10-50, or in the range of 15-30, or in the range of 20-25.

In some embodiments, the one or more alcohol ethoxylate compounds are straight chain hydrophobes.

In at least some embodiments, the sheeting agent component includes at least two different alcohol ethoxylate compounds each having structure represented by Formula I. In other words, the R and/or n variables of Formula I, or both, may be different in the two or more different alcohol ethoxylate compounds present in the sheeting component. For example, the sheeting agent component in some embodiments may include a first alcohol ethoxylate compound in which R is a ($C_8$-$C_{10}$)alkyl group, and a second alcohol ethoxylate compound in which R is a ($C_{10}$-$C_{12}$)alkyl group. In at least some embodiments, the sheeting agent component does not include any alcohol ethoxylate compounds that include an alkyl group that has more than 12 carbon atoms. In some embodiments, the sheeting agent component includes only alcohol ethoxylate compounds that include an alkyl group that has 12 or fewer carbon atoms.

In some embodiments where, for example, the sheeting agent component includes at least two different alcohol ethoxylate compounds, the ratio of the different alcohol ethoxylate compounds can be varied to achieve the desired characteristics of the final composition. For example, in some embodiments including a first alcohol ethoxylate compound and a second alcohol ethoxylate compound, the ratio of weight-percent first alcohol ethoxylate compound to weight—percent second compound may be in the range of about 1:1 to about 10:1 or more. For example, in some embodiments, the sheeting agent component can include in the range of about 50 weight percent or more of the first compound, and in the range of about 50 weight percent or less of the second compound, and/or in the range of about 75 weight percent or more of the first compound, and in the range of about 25 weight percent or less of the second compound, and/or in the range of about 85 weight percent or more of the first compound, and in the range of about 15 weight percent or less of the second compound. Similarly, the range of mole ratio of the first compound to the second compound may be about 1:1 to about 10:1, and in some embodiments, in the range of about 3:1 to about 9:1.

In some embodiments, the alcohol ethoxylates used in the sheeting agent component can be chosen such that they have certain characteristics, for example, are environmentally friendly, are suitable for use in food service industries, and/or the like. For example, the particular alcohol ethoxylates used in the sheeting agent may meet environmental or food service regulatory requirements, for example, biodegradability requirements.

Some specific examples of suitable sheeting agent components that may be used include an alcohol ethoxylate combination including a first alcohol ethoxylate wherein R is a $C_{10}$ alkyl group and n is 21 (i.e. 21 moles ethylene oxide) and a second alcohol ethoxylate wherein R is a $C_{12}$ alkyl group and again, n is 21 (i.e. 21 moles ethylene oxide). Such a combination can be referred to as an alcohol ethoxylate $C_{10\text{-}12}$, 21 moles EO. In some particular embodiments, the sheeting agent component may include in the range of about 85 wt. % or more of the $C_{10}$ alcohol ethoxylate and about 15 wt. % or less of the $C_{12}$ alcohol ethoxylate. For example, the sheeting agent component may include in the range of about 90 wt. % of the $C_{10}$ alcohol ethoxylate and about 10 wt. % of the $C_{12}$ alcohol ethoxylate. One example of such an alcohol ethoxylate mixture is commercially available from Sasol as NOVEL II 1012-21.

The sheeting agent component can comprise a very broad range of weight percent of the entire composition, depending upon the desired properties. For example, for concentrated embodiments, the sheeting agent component can comprise in the range of 1 to about 10 wt.-% of the total composition, in some embodiments in the range of about 5 to about 25 wt.-% of the total composition, in some embodiments in the range of about 20 to about 50 wt.-% of the total composition, and in some embodiments in the range of about 40 to about 90 wt.-% of the total composition. For some diluted or use solutions, for example, aqueous use solutions, the sheeting agent component can comprise in the range of 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the total use solution.

Defoamer Component

The rinse aid composition can also include an effective amount of a defoamer component configured for reducing the stability of foam that may be created by the alcohol ethoxylate sheeting agent component in an aqueous solution. Any of a broad variety of suitable defoamers may be used, for example, any of a broad variety of nonionic ethylene oxide (EO) containing surfactants. Many nonionic ethylene oxide derivative surfactants are water soluble and have cloud points below the intended use temperature of the rinse aid composition, and therefore may be useful defoaming agents.

While not wishing to be bound by theory, it is believed that suitable nonionic EO containing surfactants are hydrophilic and water soluble at relatively low temperatures, for example, temperatures below the temperatures at which the rinse aid will be used. It is theorized that the EO component forms hydrogen bonds with the water molecules, thereby solubilizing the surfactant. However, as the temperature is increased, these hydrogen bonds are weakened, and the EO containing surfactant becomes less soluble, or insoluble in water. At some point, as the temperature is increased, the cloud point is reached, at which point the surfactant precipitates out of solution, and functions as a defoamer. The surfactant can therefore act to defoam the sheeting agent component when used at temperatures at or above this cloud point.

The cloud point of nonionic surfactants of this class is defined as the temperature at which a 1 wt-% aqueous solution. Therefore, the surfactant and/or surfactants chosen for use in the defoamer component can include those having appropriate cloud points that are below the intended sue temperature of the rinse aid. Those of skill in the art, knowing the intended use temperature of the rinse aid, will appreciate surfactants with appropriate cloud points for use as defoamers.

For example, there are two general types of rinse cycles in commercial warewashing machines. A first type of rinse cycle can be referred to as a hot water sanitizing rinse cycle because of the use of generally hot rinse water (about 180° F.). A second type of rinse cycle can be referred to as a chemical sanitizing rinse cycle and it uses generally lower temperature rinse water (about 120° F.). A surfactant useful as a defoamer in these two conditions is one having a cloud point less than the rinse water temperature. Accordingly, in this example, the highest useful cloud point, measured using a 1 wt-% aqueous solution, for the defoamer is approximately 180° F. or less. It should be understood, however, that the cloud point can be lower or higher, depending on the use locus water temperature. For example, depending upon the use locus water temperature, the cloud point may be in the range of about 0 to about 100° C. Some examples of common suitable cloud points may be in the range of about 50° C. to about 80° C., or in the range of about 60° C. to about 70° C.

Some examples of ethylene oxide derivative surfactants that may be used as defoamers include polyoxyethylene-polyoxypropylene block copolymers, alcohol alkoxylates, low molecular weight EO containing surfactants, or the like, or derivatives thereof. Some examples of polyoxyethylene-polyoxypropylene block copolymers include those having the following formulae:

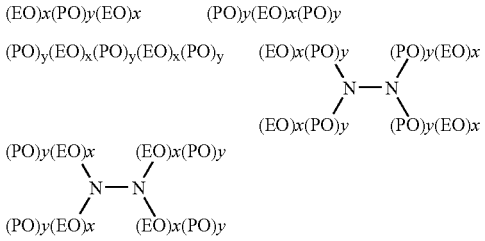

wherein EO represents an ethylene oxide group, PO represents a propylene oxide group, and x and y reflect the average molecular proportion of each alkylene oxide monomer in the overall block copolymer composition. In some embodiments, x is in the range of about 10 to about 130, y is in the range of about 15 to about 70, and x plus y is in the range of about 25 to about 200. It should be understood that each x and y in a molecule can be different. In some embodiments, the total polyoxyethylene component of the block copolymer can be in the range of at least about 20 mol-% of the block copolymer and in some embodiments, in the range of at least 30 mol-% of the block copolymer. In some embodiments, the material can have a molecular weight greater than about 400, and in some embodiments, greater than about 500. For example, in some embodiments, the material can have a molecular weight in the range of about 500 to about 7000 or more, or in the range of about 950 to about 4000 or more, or in the range of about 1000 to about 3100 or more, or in the range of about 2100 to about 6700 or more.

Although the exemplary polyoxyethylene-polyoxypropylene block copolymer structures provided above have 3-8 blocks, it should be appreciated that the nonionic block copolymer surfactants can include more or less than 3 or 8 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Some examples of suitable block copolymer surfactants include commercial products such as PLURONIC® and TETRONIC® surfactants, commercially available from BASF. For example, PLURONIC® 25-R4 is one example of a useful block copolymer surfactant commercially available from BASF.

It is believed that one skilled in the art would understand that a nonionic surfactant with an unacceptably high cloud point temperature or an unacceptably high molecular weight would either produce unacceptable foaming levels or fail to provide adequate defoaming capacity in a rinse aid composition.

The defoamer component can comprise a very broad range of weight percent of the entire composition, depending upon the desired properties. For example, for concentrated embodiments, the defoamer component can comprise in the range of about 1 to about 10 wt.-% of the total composition, in some embodiments in the range of about 5 to about 25 wt.-% of the total composition, in some embodiments in the range of about 20 to about 50 wt.-% of the total composition, and in some embodiments in the range of about 40 to about 90 wt. -% of the total composition. For some diluted or use solutions, the defoamer component can comprise in the range of about 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the use solution.

The amount of defoamer component present in the composition can also be dependent upon the amount of sheeting agent present in the composition. For example, the less sheeting agent present in the composition may provide for the use of less defoamer component. In some example embodiments, the ratio of weight-percent sheeting agent component to weight-percent defoamer component may be in the range of about 1:5 to about 5:1, or in the range of about 1:3 to about 3:1. Those of skill in the art will recognize that the ratio of sheeting agent component to defoamer component may be dependent on the properties of either and/or both actual components used, and these ratios may vary from the example ranges given to achieve the desired defoaming effect.

Additional Functional Materials

In addition to the sheeting agent component and the defoamer component, the rinse aid may also optionally include a number of additional additives and/or functional materials. For example, the rinse aid can additionally include chelating/sequestering agents, bleaches and/or bleach activators, sanitizers and/or anti-microbial agents, activators, detergent builder or fillers, anti-redeposition agents, optical brighteners, dyes, odorants or perfumes, preservatives, stabilizers, processing aids, corrosion inhibitors, fillers, solidifiers, hardening agent, solubility modifiers, pH adjusting agents, humectants, hydrotopes, water treatment polymers and/or phosphonates, functional polydimethylsiloxones, or the like, or any other suitable additive, or mixtures or combinations thereof.

Chelating/Sequestering Agents

The rinse may optionally include one or more chelating/sequestering agent as a functional ingredient. A chelating/sequestering agent may include, for example an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other ingredients of a rinse aid or other cleaning composition. The chelating/sequestering agent may also function as a threshold agent when included in an effective amount. In some embodiments, a solid rinse aid can include in the range of up to about 70 wt. %, or in the range of about 1-60 wt. %, of a chelating/sequestering agent.

Some examples of aminocarboxylic acids include, N-hydroxethyliminodiacetic acid, nitrilotriacetic acid (NTA), etylenediaminetetraacetic acid (EDTA), N-hydroxyethyl-ethylenediaminietriacetic acid (HEDTA) (in addition to the HEDTA used in the binder), diethylenetriaminepentaacetic acid (DTPA), and the like.

Some examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate), sodium salt

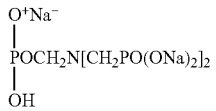

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$. In some embodiments, a phosphonate combination such as ATMP and DTPMP may be used. A neutralized or alkaline phosphonate, or a combination of the phosphonate with an alkali source prior to being added into the mixture such that there is little or no heat or gas generated by a neutralization reaction when the phosphonate is added can be used.

Some examples of polymeric polycarboxylates suitable for use as sequestering agents include those having a pendant carboxylate (—$CO_2$) group and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Bleaching Agents

The rinse aid can optionally include a bleaching agent. Bleaching agents can be used for lightening or whitening a substrate, and can include bleaching compounds capable of liberating an active halogen species, such as $Cl_2$, $Br_2$, —$OCl^-$and/or —$OBr^-$, or the like, under conditions typically encountered during the cleansing process. Suitable bleaching agents for use can include, for example, chlorine-containing compounds such as a chlorine, a hypochlorite, chloramines, of the like. Some examples of halogen-releasing compounds include the alkali metal dichloroisocyanurates, chlorinated trisodium phosphate, alkali metal hypochlorites, monochloramine, dichloroamine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein). A bleaching agent may also include an agent containing or acting as a source of active oxygen. The active oxygen compound acts to provide a source of active oxygen, for example, may release active oxygen in aqueous solutions. An active oxygen compound can be inorganic or organic, or can be a mixture thereof. Some examples of active oxygen compounds include peroxygen compounds, or peroxygen compound adducts. Some examples of active oxygen compounds or sources include hydrogen peroxide, perborates, sodium carbonate peroxyhydrate, phosphate peroxyhydrates, potassium permonosulfate, and sodium perborate mono and tetrahydrate, with and without activators such as tetraacetylethylene damine, and the like. A rinse aid composition may include a minor but effective amount of a bleaching agent, for example, in some embodiments, in the range of up to about 10 wt. %, and in some embodiments, in the range of about 0.1 to about 6 wt. %.

Sanitizers/Anti-Microbial Agents

The rinse aid can optionally include a sanitizing agent. Sanitizing agents also known as antimicrobial agents are chemical compositions that can be used in a solid functional material to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action. Nonetheless, some embodiments incorporate additional antimicrobial agents.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Some examples of common antimicrobial agents include phenolic antimicrobials such as pentachlorophenol, orthophenylphenol, a chloro-p-benzylphenol, p-chloro-m-xylenol. Halogen containing antibacterial agents include sodium trichloroisocyanurate, sodium dichloro isocyanate (anhydrous or dihydrate), iodine-poly(vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties. In some embodiments, the cleaning composition comprises sanitizing agent in an amount effective to provide a desired level of sanitizing. In some embodiments, an antimicrobial component, such as TAED can be included in the range of up to about 75% by wt. of the composition, in some embodiments in the range of up to about 20 wt. %, or in some embodiments, in the range of about 0.01 to about 20 wt. %, or in the range of 0.05 to 10% by wt of the composition.

Activators

In some embodiments, the antimicrobial activity or bleaching activity of the rinse aid can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof.

In some embodiments, an activator component can include in the range of up to about 75% by wt. of the composition, in some embodiments, in the range of about 0.01 to about 20% by wt, or in some embodiments, in the range of about 0.05 to 10% by wt of the composition. In some embodiments, an activator for an active oxygen compound combines with the active oxygen to form an antimicrobial agent.

In some embodiments, the rinse aid composition includes a solid, such as a solid flake, pellet, or block, and an activator material for the active oxygen is coupled to the solid. The activator can be coupled to the solid by any of a variety of methods for coupling one solid cleaning composition to another. For example, the activator can be in the form of a solid that is bound, affixed, glued or otherwise adhered to the solid of the rinse aid composition. Alternatively, the solid activator can be formed around and encasing the solid rinse aid composition. By way of further example, the solid activator can be coupled to the solid rinse aid composition by the container or package for the composition, such as by a plastic or shrink wrap or film.

Builders or Fillers

The rinse aid can optionally include a minor but effective amount of one or more of a filler which does not necessarily perform as a rinse and/or cleaning agent per se, but may cooperate with a rinse agent to enhance the overall capacity of the composition. Some examples of suitable fillers may include sodium sulfate, sodium chloride, starch, sugars, $C_1$-$C_{10}$ alkylene glycols such as propylene glycol, and the like. In some embodiments, a filler can be included in an amount in the range of up to about 20 wt. %, and in some embodiments, in the range of about 1-15 wt. %.

Anti-Redeposition Agents

The rinse aid composition can optionally include an anti-redeposition agent capable of facilitating sustained suspension of soils in a rinse solution and preventing removed soils from being redeposited onto the substrate being rinsed. Some examples of suitable anti-redeposition agents can include fatty acid amides, fluorocarbon surfactants, complex phosphate esters, styrene maleic anhydride copolymers, and cellulosic derivatives such as hydroxyethyl cellulose, hydroxypropyl cellulose, and the like. A rinse aid composition may include up to about 10 wt. %, and in some embodiments, in the range of about 1 to about 5 wt. %, of an anti-redeposition agent.

Dyes/Odorants

Various dyes, odorants including perfumes, and other aesthetic enhancing agents may also be included in the rinse aid. Dyes may be included to alter the appearance of the composition, as for example, FD&C Blue 1 (Sigma Chemical), FD&C Yellow 5 (Sigma Chemical), Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Hardening/Solidification Agents/Solubility Modifiers

A rinse aid may include an effective amount of a hardening agent, as for example, an amide such as stearic monoethanolamide or lauric diethanolamide, or an alkylamide, and the like; a solid polyethylene glycol, or a solid EO/PO block copolymer, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the rinse aid and/or other active ingredients may be dispensed from the solid composition over an extended period of time. The composition may include a secondary hardening agent in an amount in the range of up to about 20 wt-%, or in some embodiments, in the range of about 5 to about 15 wt-%.

Additional Sheeting Aids

The composition can optionally include one or more additional rinse aid components, for example, an additional wetting or sheeting agent in addition to the alcohol ethoxylate sheeting component discussed above. For example, water soluble or dispersible low foaming organic material capable of aiding in reducing the surface tension of the rinse water to promote sheeting action and/or to aid in reducing or preventing spotting or streaking caused by beaded water after rinsing is complete may also be included. Such sheeting agents are typically organic surfactant like materials having a characteristic cloud point. Surfactants useful in these applications are aqueous soluble surfactants having a cloud point greater than the available hot service water, and the cloud point can vary, depending on the use locus hot water temperature and the temperature and type of rinse cycle.

Some examples of additional sheeting agents can typically comprise a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents can have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly(PO) or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below:

$$(EO)_n—(PO)_m—(EO)_n$$

wherein m is an integer of 20 to 60, and each end is independently an integer of 10 to 130. Another useful block copolymer are block copolymers having a center block of polyoxyethylene units and blocks of polyoxypropylene to each side of the center block. Such copolymers have the formula:

$$(PO)_n—(EO)_m—(PO)_n$$

wherein m is an integer of 15 to 175, and each end are independently integers of about 10 to 30. For solid compositions, a hydrotrope may be used to aid in maintaining the solubility of sheeting or wetting agents. Hydrotropes can be used to modify the aqueous solution creating increased solubility for the organic material. In some embodiments, hydrotropes are low molecular weight aromatic sulfonate materials such as xylene sulfonates and dialkyldiphenyl oxide sulfonate materials.

Functional Polydimethylsiloxones

The composition can also optionally include one or more functional polydimethylsiloxones. For example, in some embodiments, a polyalkylene oxide-modified polydimethylsiloxane, nonionic surfactant or a polybetaine-modified polysiloxane amphoteric surfactant can be employed as an additive. Both, in some embodiments, are linear polysiloxane copolymers to which polyethers or polybetaines have been grafted through a hydrosilation reaction. Some examples of specific siloxane surfactants are known as SILWET® surfactants available from Union Carbide or ABIL® polyether or polybetaine polysiloxane copolymers available from Goldschmidt Chemical Corp., and described in U.S. Pat. No. 4,654,161 which patent is incorporated herein by reference. In some embodiments, the particular siloxanes used can be described as having, e.g., low surface tension, high wetting ability and excellent lubricity. For example, these surfactants are said to be among the few capable of wetting polytetrafluoroethylene surfaces. The siloxane surfactant employed as an additive can be used alone or in combination with a fluorochemical surfactant. In some embodiments, the fluorochemical surfactant employed as an additive optionally in combination with a silane, can be, for example, a nonionic fluorohydrocarbon, for example, fluorinated alkyl polyoxyethylene ethanols, fluorinated alkyl alkoxylate and fluorinated alkyl esters.

Further description of such functional polydimethylsiloxones and/or fluorochemical surfactants are described in U.S. Pat. Nos. 5,880,088; 5,880,089; and 5,603,776, all of which patents are incorporated herein by reference. We have found, for example, that the use of certain polysiloxane copolymers in a mixture with hydrocarbon surfactants provide excellent rinse aids on plasticware. We have also found that the combination of certain silicone polysiloxane copolymers and fluorocarbon surfactants with conventional hydrocarbon surfactants also provide excellent rinse aids on plasticware. This combination has been found to be better than the individual components except with certain polyalkylene oxide-modified polydimethylsiloxanes and polybetaine polysiloxane copolymers, where the effectiveness is about equivalent. Therefore, some embodiments encompass the polysiloxane copolymers alone and the combination with the fluorocarbon surfactant can involve polyether polysiloxanes, the nonionic siloxane surfactants. The amphoteric siloxane surfactants, the polybetaine polysiloxane copolymers may be employed alone as the additive in the rinse aids to provide the same results.

In some embodiments, the composition may include functional polydimethylsiloxones in an amount in the range of up to about 10 wt-%. For example, some embodiments may include in the range of about 0.1 to 10 wt-% of a polyalkylene oxide-modified polydimethylsiloxane or a polybetaine-modified polysiloxane, optionally in combination with about 0.1 to 10 wt-% of a fluorinated hydrocarbon nonionic surfactant.

Humectant

The composition can also optionally include one or more humectant. A humectant is a substance having an affinity for water. The humectant can be provided in an amount sufficient to aid in reducing the visibility of a film on the substrate surface. The visibility of a film on the substrate surface is a particular concern when the rinse water contains in excess of 200 ppm total dissolved solids. Accordingly, in some embodiments, the humectant is provided in an amount sufficient to reduce the visibility of a film on a substrate surface when the rinse water contains in excess of 200 ppm total dissolved solids compared to a rinse agent composition not containing the humectant. The terms "water solids filming" or "filming" refer to the presence of a visible, continuous layer of matter on a substrate surface that gives the appearance that the substrate surface is not clean.

Some example humectants that can be used include those materials that contain greater than 5 wt. % water (based on dry humectant) equilibrated at 50% relative humidity and room temperature. Exemplary humectants that can be used include glycerin, propylene glycol, sorbitol, alkyl polyglycosides, polybetaine polysiloxanes, and mixtures thereof. In some embodiments, the rinse agent composition can include humectant in an amount in the range of up to about 75% based on the total composition, and in some embodiments, in the range of about 5 wt. % to about 75 wt. % based on the weight of the composition. In some embodiments, where humectant is present, the weight ratio of the humectant to the sheeting agent can be in the range of about 1:3 or greater, and in some embodiments, in the range of about 5:1 and about 1:3.

Other Ingredients

A wide variety of other ingredients useful in providing the particular composition being formulated to include desired properties or functionality may also be included. For example, the rinse aid may include other active ingredients, such as pH buffers, cleaning enzyme, carriers, processing aids, solvents for liquid formulations, or others, and the like.

Additionally, the rinse aid can be formulated such that during use in aqueous operations, for example in aqueous cleaning operations, the rinse water will have a desired pH. For example, compositions designed for use in rinsing may be formulated such that during use in aqueous rinsing operation the rinse water will have a pH in the range of about 3 to about 5, or in the range of about 5 to about 9. Liquid product formulations in some embodiments have a (10% dilution) pH in the range of about 2 to about 4, or in the range of about 4 to about 9. Techniques for controlling pH at recommended usage levels include the use of buffers, alkali, acids, etc., and are well known to those skilled in the art. One example of a suitable acid for controlling pH includes citric acid.

Processing and/or Manufacturing of the Composition

The invention also relates to a method of processing and/or making the rinse aid composition. The rinse aid composition can be processed using any of a broad variety of techniques, dependent at least somewhat upon the formulation and the desired form of the rinse aid composition. For example, the rinse agent can be provided as a concentrate or as a use solution. In addition, the rinse agent concentrate can be provided in a solid form or in a liquid form. In general, it is expected that the concentrate will be diluted with water to provide the use solution that is then supplied to the surface of a substrate, for example, during a rinse cycle. The use solution preferably contains an effective amount of active material to provide reduced water solids filming in high solids containing water.

In some example embodiments, when the rinse agent is provided as a liquid, such component that functions as a carrier and cooperates with aqueous diluents to form an aqueous rinse agent. Exemplary liquid bases include water and solvents compatible with water to obtain compatible mixtures. The rinse agent of the invention can be formulated using conventional formulating equipment and techniques. Additionally, liquid rinse agents according to the invention can be manufactured in commonly available mixing equipment by charging to a mixing chamber the liquid diluent or a substantial proportion of a liquid diluent. Into a liquid diluent is added the other ingredients and/or components, and mixed. Care must be taken in agitating the rinse agent as the formulation is completed to avoid degradation of polymer molecular weight or exposure of the composition to undesirable temperatures. The materials are typically agitated until uniform and then packaged in commonly available packaging and sent to a distribution center before shipment to the consumer.

In some other example embodiments, a solid concentrate rinse agent is provided which can then be diluted with water to provide the use solution. The desired amount of the sheeting agent component and the defoamer component is provided, along with any other optional ingredients, such as one or more solidification agents, and the components are admixed in an effective solidifying amount of the ingredients. The solid rinse agent can be formulated using conventional formulating equipment and techniques.

Additionally, solid rinse agents accordingly can be manufactured in commonly available mixing equipment. It should be understood that compositions and methods embodying the invention are suitable for preparing a variety of solid compositions, as for example, a cast, extruded, molded or formed solid pellet, block, tablet, powder, granule, flake, and the like, or the formed solid or aggregate can thereafter be ground or formed into a powder, granule, flake, and the like. In some embodiments, the solid composition can be formed to have a weight of 50 grams or less, while in other embodiments, the solid composition can be formed to have a weight of 50 grams or greater, 500 grams or greater, or 1 kilogram or greater. For the purpose of this application the term "solid block" includes cast, formed, or extruded materials having a weight of 50 grams or greater. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

The liquid materials of the invention can be adapted to a solid by incorporating into the composition a casting agent. Typically organic and inorganic solidifying materials can be used to render the composition solid. In some embodiments, organic materials are used because at least some inorganic compositions tend to promote spotting in a rinse cycle. One example of a suitable solidifying agent is urea, and the process, known to those of skill in the art, is the urea occlusion process. For example, some examples of casting agents include polyethylene glycol and an inclusion complex comprising urea and a nonionic polyethylene or polypropylene oxide polymer. In some embodiments, polyethylene glycols (PEG) are used in melt type solidification processing by uniformly blending the sheeting agent and other components with PEG at a temperature above the melting point of the PEG and cooling the uniform mixture. An inclusion complex solidifying scheme is set forth in U.S. Pat. No. 4,647,258, which is incorporated herein by reference. An additional solidifying scheme is set forth in U.S. Pat. No. 5,674,831, which is incorporated herein by reference.

In some embodiments, in the formation of a solid composition, a mixing system may be used to provide for continuous mixing of the ingredients at high enough shear to form a substantially homogeneous solid or semi-solid mixture in which the ingredients are distributed throughout its mass. In some embodiments, the mixing system includes means for mixing the ingredients to provide shear effective for maintaining the mixture at a flowable consistency, with a viscosity during processing in the range of about 1,000-1,000,000 cP, or in the range of about 50,000-200,000 cP. In some example embodiments, the mixing system can be a continuous flow mixer or in some embodiments, an extruder, such as a single or twin screw extruder apparatus. A suitable amount of heat may be applied from an external source to facilitate processing of the mixture.

The mixture is typically processed at a temperature to maintain the physical and chemical stability of the ingredients. In some embodiments, the mixture is processed at ambient temperatures in the range of about 20° C. to about 80° C., or in some embodiments, in the range of about 25° C. to about 55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the sheeting agent, the defoamer, an aqueous medium, and additional ingredients such as a hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate then can be divided into useful sizes with a controlled mass.

The composition hardens due to the chemical or physical reaction of the requisite ingredients forming the solid. The solidification process may last from a few minutes to about six hours, or more, depending, for example, on the size of the cast or extruded composition, the ingredients of the composition, the temperature of the composition, and other like factors. In some embodiments, the cast or extruded composition "sets up" or begins to hardens to a solid form within about 1 minute to about 3 hours, or in the range of about 1 minute to about 2 hours, or in some embodiments, within about 1 minute to about 20 minutes.

In some embodiments, the extruded solid can be packaged, for example in a container or in film. The temperature of the mixture when discharged from the mixing system can be sufficiently low to enable the mixture to be cast or extruded directly into a packaging system without first cooling the mixture. The time between extrusion discharge and packaging may be adjusted to allow the hardening of the composition for better handling during further processing and packaging. In some embodiments, the mixture at the point of discharge is in the range of about 20° C. to about 90° C., or in some embodiments, in the range of about 25° C. to about 55° C. The composition is then allowed to harden to a solid form that may range from a low density, sponge-like, malleable, caulky consistency to a high density, fused solid, concrete-like solid.

Optionally, heating and cooling devices may be mounted adjacent to the mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. In some embodiments, the temperature of the mixture during processing, including at the discharge port, is maintained in the range of about 20° C. to about 90° C.

Packaging System

The rinse aid can be, but is not necessarily, incorporated into a packaging system or receptacle. The packaging receptacle or container may be rigid or flexible, and include any material suitable for containing the compositions produced, as for example glass, metal plastic film or sheet, cardboard, cardboard composites, paper, or the like. For liquid compositions, the materials are typically agitated until uniform and then packaged in commonly available packaging and sent to a distribution center before shipment to the consumer. For solid compositions, after formation of the solids, the composition can likewise be packaged in commonly available packaging and sent to a distribution center before shipment to the consumer.

For solids, advantageously, in at least some embodiments, since the rinse aid is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that are processed and dispensed under molten conditions. In some embodiments, the packaging used to contain the rinse aid is manufactured from a flexible, easy opening film material.

Dispensing/Use of the Rinse Aid

The rinse aid can be dispensed as a concentrate or as a use solution. In addition, the rinse aid concentrate can be provided in a solid form or in a liquid form. In general, it is expected that the concentrate will be diluted with water to provide the use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a rinse application, for example, during a rinse cycle, for example, in a warewashing machine, a car wash application, or the like. In some embodiments, formation of a use solution can occur from a rinse agent installed in a cleaning machine, for example onto a dish rack. The rinse agent can be diluted and dispensed from a dispenser mounted on or in the machine or from a separate dispenser that is mounted separately but cooperatively with the dish machine.

For example, in some embodiments, liquid rinse agents can be dispensed by incorporating compatible packaging containing the liquid material into a dispenser adapted to diluting the liquid with water to a final use concentration. Some examples of dispensers for the liquid rinse agent of the invention are DRYMASTER-P sold by Ecolab Inc., St. Paul, Minn.

In other example embodiments, solid products, such as cast or extruded solid compositions, may be conveniently dispensed by inserting a solid material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a warewashing machine in the rinse cycle. When demanded by the machine, the dispenser directs a spray of water onto the cast solid block of rinse agent which effectively dissolves a portion of the block creating a concentrated aqueous rinse solution which is then fed directly into the rinse water forming the aqueous rinse. The aqueous rinse is then contacted with the dishes to affect a complete rinse. This dispenser and other similar dispensers are capable of controlling the effective concentration of the active portion in the aqueous rinse by measuring the volume of material dispensed, the actual concentration of the material in the rinse water (an electrolyte measured with an electrode) or by measuring the time of the spray on the cast block. In general, the concentration of active portion in the aqueous rinse is preferably the same as identified above for liquid rinse agents. Some other embodiments of spray-type dispenser are disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. An example of a particular product shape is shown in FIG. 9 of U.S. Pat. No. 6,258,765, which is incorporated herein by reference.

In some embodiments, the rinse aid may be formulated for a particular application. For example, in some embodiments, the rinse aid may be particularly formulated for use in warewashing machines. As discussed above, there are two general types of rinse cycles in commercial warewashing machines. A first type of rinse cycle can be referred to as a hot water sanitizing rinse cycle because of the use of generally hot rinse water (about 180° F.). A second type of rinse cycle can be referred to as a chemical sanitizing rinse cycle and it uses generally lower temperature rinse water (about 120° F.).

In some embodiments, it is believed that the rinse aid composition of the invention can be used in a high solids containing water environment in order to reduce the appearance of a visible film caused by the level of dissolved solids provided in the water. In general, high solids containing water is considered to be water having a total dissolved solids (TDS) content in excess of 200 ppm. In certain localities, the service water contains a total dissolved solids content in excess of 400 ppm, and even in excess of 800 ppm. The applications where the presence of a visible film after washing a substrate is a particular problem include the restaurant or warewashing industry, the car wash industry, and the general cleaning of hard surfaces. Exemplary articles in the warewashing industry that can be treated with a rinse aid according to the invention include dishware, cups, glasses, flatware, and cookware. For the purposes of this invention, the terms "dish" and "ware" are used in the broadest sense to refer to various types of articles used in the preparation, serving consumption, and disposal of food stuffs including pots, pans, tray, pitchers, bowls, plates, saucers, cups, glasses, forks, knives, spoons,. spatulas, and other glass, metal, ceramic, plastic composite articles commonly available in the institutional or household kitchen or dining room. In general, these types of articles can be referred to as food or beverage contacting articles because they have surfaces which are provided for contacting food and/or beverage. When used in these warewashing applications, the rinse aid should provide effective sheeting action and low foaming properties. In addition to having the desirable properties described above, it may also be useful for the rinse aid to be biodegradable, enviromnentally friendly, and generally nontoxic. A rinse aid of this type may be described as being "food grade".

The above description provides a basis for understanding the broad meets and bounds of the invention. The following examples and test data provide an understanding of certain specific embodiments of the invention. The invention will be further described by reference to the following detailed examples. These examples are not meant to limit the scope of the invention. Variation within the concepts of the invention are apparent to those skilled in the art.

EXAMPLES

Example 1

In this example, a solid rinse aid composition was made including the components in the weight percents listed Table 1 using an extrusion technique.

TABLE 1

| Component | Wt- % | General Function of Component |
|---|---|---|
| LD-O97[1] | 31.82 | defoamer and sheeting agent |
| DO97[2] | 11.74 | defoamer and sheeting agent |
| NOVEL II 1012-21[3] | 18.10 | sheeting agent |
| Neodol 25-12[4] | 5.17 | sheeting agent |
| Soft Water | 1.46 | diluent/processing aid |
| HCl, 31.5% | 0.11 | pH modifier |
| Abil B 9950[5] | 2.59 | sheeting agent |
| FD&C Blue #1, 34% | 0.18 | dye |
| FD&C Yellow #5, XX % | 0.01 | dye |
| Kathon CG-ICP[6] | 2.80 | preservative |
| Urea, Prilled | 26.00 | solidifying agent |

[1]Polyoxypropylene Polyoxyethylene Block copolymer
[2]Polyoxypropylene Polyoxyethylene Block copolymer
[3]Alcohol Ethoxylate $C_{10-12}$, 21Moles Ethylene Oxide, 90% $C_{10}$, 10% $C_{12}$
[4]Linear Alcohol $C_{12-15}$, 12 Mole Ethoxylate
[5]Dimethicone Propyl PG - Betaine, 30%
[6]Chloro Methyl Isothiazolin mixture The rinse aid composition of this example was made using an extrusion process using a seven barrel 30 millimeter Werner-Pfleider extrude assembly. A urea feed stream fed into the first barrel, and a surfactant premix feed stream including the other components, and preheated to about 100° F. was fed into the third barrel. The second barrel was a high sheer barrel, and the final three barrels were mixing and/or temperature control barrels. The feed streams were mixed in the extruder, and the mixed composition was conveyed out the end of the extruder into a round die section at a temperature of about 95 to about 100° F. After extrusion the shaped product was allowed to solidify/cool. The resulting solid was found to be a useful rinse aid composition for use in warewashing applications.

Example 2

In this example, a solid rinse aid composition was made using the components in the weight percents listed in Table 2.

TABLE 2

| Component | Wt- % | General Function of Component |
|---|---|---|
| LD-097[7] | 19.34 | defoamer and sheeting agent |
| Pluronic 25-R-8 Prill[8] | 28.51 | defoamer and sheeting agent |
| Sodium Alkyl Sulfonate[9] | 5.99 | hydrotope |
| Bayhibit S[10] | 6.00 | sequestering agent |
| SXS, 96%[11] | 5.79 | hydrotope |
| NOVEL II 1012-21[12] | 14.62 | sheeting agent |
| PEG 8000[13] | 14.60 | solidifying agent |
| Sodium Sulfate, Anhyd Fine Grain | 3.00 | filler |
| Glutaraldehyde, 50% | 0.87 | preservative |
| Hydrochloric Acid, 31.5% | 1.03 | pH modifier |
| Softened Water | 0.10 | diluent/processing aid |
| FD&C Yellow #5, XX % | 0.04 | dye |
| FD&C Blue #1, XX % | 0.11 | dye |

[7]Polyoxypropylene Polyoxyethylene Block copolymer
[8]Polyoxypropylene Polyoxyethylene Block copolymer
[9]Sodium Octyl Sulfonate
[10]2-Phosphonobutane 1,2,4, Tricarboxylic Acid Sodium Salt
[11]Sodium Xylene Sulfonate
[12]Alcohol Ethoxylate $C_{10-12}$, 21Moles Ethylene Oxide, 90% $C_{10}$, 10% $C_{12}$
[13]Polyethylene glycol 8000 mol. wt.

This solid rinse aid composition was made by combining the above-listed components in a series of processing steps. The first step was to mix the LD-097 and Pluronic 25-R-8 while agitating and heating. When the temperature reached at least 150° F., the next step was to add the sodium alkyl sulfonate, bayhibit S, and SXS and mix until the components appeared to be evenly dispersed. At that point, the NOVEL II 1012-21 and PEG 8000 were added and the admixture was cooled 140-150° F. The sodium sulfate was then added and the product was mixed until the components appeared evenly dispersed. The glutaraldehyde was then added when the temperature was below 150° F. The pH of the mixture was adjusted by adding HCl so that a 10% solution in water had a pH of 5.0-7.0. Finally, the dyes (which were pre-mixed for at least 15 minutes with water so that they were completely dispersed in the water) were added. The product was allowed to cool and solidify. The resulting solid was found to be a useful rinse aid composition for use in warewashing applications.

Example 3

In this example, a solid rinse aid composition was made using the components in the weight percents listed in Table 3.

TABLE 3

| Component | Wt- % | General Function of Component |
|---|---|---|
| NOVEL II 1012-21[14] | 36.488 | sheeting agent |
| Pluronic 25-R8[15] | 8.012 | solidifying agent |
| SXS 96%[16] | 16.024 | hydrotope |

TABLE 3-continued

| Component | Wt- % | General Function of Component |
|---|---|---|
| Peg 8000[17] | 18.224 | Solidifying agent |
| LD-097[18] | 20.000 | defoamer and sheeting agent |
| Glutaraldehyde, 50% | 1.122 | preservative |
| FD&C Blue #1, 34% | 0.130 | dye |

[14]Alcohol Ethoxylate $C_{10-12}$, 21Moles Ethylene Oxide, 90% $C_{10}$, 10% $C_{12}$
[15]Polyoxypropylene Polyoxyethylene Block copolymer
[16]Sodium Xylene Sulfonate
[17]Polyethylene glycol 8000 mol. wt.
[18]Polyoxypropylene Polyoxyethylene Block copolymer This solid rinse aid composition was made by combining the above-listed components in a series of processing steps. The first step was to slowly combine the NOVEL II 1012-21, Pluronic 25-R8, SXS, and Peg 8000 while maintaining the temperature at 150° F. This combination was mixed for 30 minutes so that all the components were dissolved. Next, the LD-097 was added and the components were mixed 20-30 minutes. The temperature was then allowed to drop naturally by removing the heat source. Once the temperature was between 125° F. and 140° F. (but not below 125° F.), the gluteraldehyde was added and the mixture was mixed 20 minutes. Finally, the dyes, which were mixed at least 15 minutes with water or until the dyes were completely dispersed in water, were added and mixed in for 20 minutes. The product was then allowed to cool and solidify.

The resulting solid was found to be a useful rinse aid composition for use in warewashing applications.

Example 4

In this example, a number of solid rinse aid formulations were manufactured and then tested for sheeting performance and for the formation of stable foam during use in an aqueous rinse solution. Specifically, formulations A through I were made using the components in the weight percents listed in Table 4.

TABLE 4

| | Rinse Aid Formulation | | | | | | | | |
|---|---|---|---|---|---|---|---|---|---|
| Component | A | B | C | D | E | F | G | H | I |
| LD-O97[19] (defoamer) | 32.83% | 32.81% | 39.65% | 39.64% | 32.82% | 32.80% | 32.73% | 32.80% | 32.84% |
| DO97[20] (defoamer) | 12.12% | 12.11% | 14.64% | 14.63% | 12.12% | 12.10% | 12.07% | 12.11% | 12.11% |
| SLF 18B-45[21] (defoamer) | 18.68% | | | | | | | | |
| BRIJ 700[23] (sheeting agent) | | | 9.33% | | | | | | |
| Volpo S-20[24] (sheeting agent) | | 18.68% | | 9.34% | | | | | |
| Galenol 2100[25] (sheeting agent) | | | | | | 18.71% | | | |
| Galenol 2800[26] (sheeting agent) | | | | | 18.66% | | | | |
| NOVEL II 1012-21[27] (sheeting agent) | | | | | | | 18.62% | | |
| NOVEL II 1214-30[28] (sheeting agent) | | | | | | | | 18.66% | |
| NOVEL II 1618-50[29] (sheeting agent) | | | | | | | | | 18.66% |
| Neodol 25-12[30] (sheeting agent) | 5.35% | 5.34% | 5.37% | 5.36% | 5.35% | 5.34% | 5.43% | 5.40% | 5.37% |
| Soft Water (diluent/processing aid) | 1.51% | 1.53% | 1.53% | 1.52% | 1.52% | 1.57% | 1.53% | 1.52% | 1.54% |
| Abil B 9950[31] (sheeting agent) | 2.68% | 2.70% | 2.67% | 2.68% | 2.70% | 2.68% | 2.68% | 2.68% | 2.69% |
| Urea, Prilled (solidifying agent) | 26.83% | 26.84% | 26.81% | 26.82% | 26.83% | 26.80% | 26.94% | 26.82% | 26.80% |

[19]Polyoxypropylene Polyoxyethylene Block copolymer
[20]Polyoxypropylene Polyoxyethylene Block copolymer
[21]Capped alcohol alkoxylate
[23]Stearyl Alcohol 100 Mole Ethoxylate
[24]Stearyl Alcohol 20 Mole Ethoxylate
[25]Alcohol C16–18, 21 Mole Ethoxylate
[26]Alcohol C16–18, 28 Mole Ethoxylate
[27]Alcohol Ethoxylate $C_{10-12}$, 21Moles Ethylene Oxide, 90% $C_{10}$, 10% $C_{12}$
[28]Alcohol Ethoxylate $C_{12-14}$, 30 Moles Ethylene Oxide, 70% $C_{12}$, 30% $C_{14}$
[29]Alcohol Ethoxylate $C_{16-18}$, 50 Moles Ethylene Oxide
[30]Linear Alcohol $C_{12-15}$, 12 Mole Ethoxylate
[31]Dimethicone Propyl PG - Betaine, 30%

Each of these formulations includes the combination of a defoamer (LD-097, D097, SLF 18B-45, or combinations thereof) and a sheeting agent (BRIJ 700, Volpo S-20, Galenol 2100, Galenol 2800, NOVEL II 1012-21, NOVEL II 1214-30, NOVEL II 1618-50, or Neodol 25-12) combined with the remaining components as shown in Table 4. The solid rinse aid compositions were manufactured using an extrusion process similar to what is described in Example 1.

Testing/Results

Each of the formulations A through I was evaluated in a Champion dish machine for its sheeting ability and the results were indicated in Tables 5-13. The foam level inside the machine was also measured and indicated in Tables 5-13.

For the sheeting evaluation, a number of warewash materials were exposed to the rinse aid formulations during a series of 30 second cycles using 150° F.-160° F. water. The warewash materials used for the evaluation were a china dinner plate, a glass panel or slide, a 10 oz. glass tumbler, a melamine dinner plate, a stainless steel butter knife, and a stainless steel panel or slide. These warewash materials were meticulously cleaned prior to the test and then soiled with a solution containing a 0.2% hotpoint soil, which is a mixture of powder milk and margarine. The amount of each rinse aid formulation that was used during the wash cycles was quantified in Tables 5-13 as parts per million surfactant.

Immediately after the warewash materials were exposed to the rinse aid formulations, the appearance of the water draining off of the individual warewash materials (sheeting) was examined and evaluated. Tables 5-13 show the results of these tests. In Table 5-13, the sheeting evaluation is indicated by either a dotted line (---) signifying no sheeting, the number "one" (1) signifying pin point sheeting, or a plus sign (+) signifying complete sheeting. The test was complete when all of the warewash materials were completely sheeted.

The foam level in the machine is also noted. Generally, stable foam at any level is unacceptable. Foam that is less than one half of an inch and that is unstable and breaks to nothing soon after the machine is shut off is acceptable, but no foam is best.

Table 5 illustrates the results of the sheeting evaluation and foam measurement for formulation A.

TABLE 5

| Type of | Active Surfactant, ppm | | | | |
|---|---|---|---|---|---|
| Warewash Material | 0 | 40 | 50 | 60 | 70 |
| China Plate | — | 1 | X | X | X |
| Glass Slide | — | 1 | 1 | 1 | X |
| Glass Tumbler | — | — | 1 | X | X |
| Melamine Plate | — | 1 | X | X | X |
| Stainless Steel Knife | — | 1 | 1 | X | X |
| Stainless Steel Slide | — | 1 | 1 | X | X |
| Temperature | 156 | 150 | 150 | 150 | 150 |
| Foam, inches | | | | | no foam |

These results indicate that at 70 ppm, formulation A completely sheeted all of the warewash materials with no measurable foam remaining in the machine.

Table 6 illustrates the results of the sheeting evaluation and foam measurement for formulation B.

TABLE 6

| Type of | Active Surfactant, ppm | | | | | |
|---|---|---|---|---|---|---|
| Warewash Material | 0 | 10 | 20 | 30 | 40 | 50 |
| China Plate | — | — | 1 | X | X | X |
| Glass Slide | — | — | 1 | X | X | X |
| Glass Tumbler | — | — | 1 | X | X | X |

TABLE 6-continued

| Type of | Active Surfactant, ppm | | | | | |
|---|---|---|---|---|---|---|
| Warewash Material | 0 | 10 | 20 | 30 | 40 | 50 |
| Melamine Plate | — | — | 1 | 1 | X | X |
| Stainless Steel Knife | — | — | — | 1 | X | X |
| Stainless Steel Slide | — | — | — | — | 1 | X |
| Temperature | 156 | | | 156 | | 156 |
| Foam, inches | | | ¼ | | ⅜ | ⅜" stable foam |

These results indicate that at 50 ppm, formulation B completely sheeted all of the warewash materials. However, ⅜ inch of stable foam remained in the machine.

Table 7 illustrates the results of the sheeting evaluation and foam measurement for formulation C.

TABLE 7

| Type of | Active Surfactant, ppm | | | | | |
|---|---|---|---|---|---|---|
| Warewash Material | 0 | 10 | 20 | 30 | 40 | 50 |
| China Plate | — | — | — | — | X | X |
| Glass Slide | — | — | — | 1 | X | X |
| Glass Tumbler | — | — | — | 1 | X | X |
| Melamine Plate | — | — | — | — | 1 | X |
| Stainless Steel Knife | — | — | — | — | 1 | X |
| Stainless Steel Slide | — | — | — | — | 1 | X |
| Temperature | 156 | | | 156 | 156 | 156 |
| Foam, inches | — | ¼ | | | ¼ | ½" stable foam |

These results indicate that at 50 ppm, formulation C completely sheeted all of the warewash materials. However, ½ inch of stable foam remained in the machine.

Table 8 illustrates the results of the sheeting evaluation and foam measurement for formulation D.

TABLE 8

| Type of | Active Surfactant, ppm | | | | | |
|---|---|---|---|---|---|---|
| Warewash Material | 0 | 10 | 20 | 30 | 40 | 50 |
| China Plate | — | — | — | 1 | X | X |
| Glass Slide | — | — | — | 1 | X | X |
| Glass Tumbler | — | — | — | 1 | X | X |
| Melamine Plate | — | — | — | 1 | X | X |
| Stainless Steel Knife | — | — | — | — | 1 | X |
| Stainless Steel Slide | — | — | — | 1 | X | X |
| Temperature | | | 156 | | 152 | |
| Foam, inches | | — | thin layer | | | ¼" stable foam |

These results indicate that at 50 ppm, formulation D completely sheeted all of the warewash materials. However, ¼ inch of stable foam remained in the machine.

Table 9 illustrates the results of the sheeting evaluation and foam measurement for formulation E.

TABLE 9

| Type of | Active Surfactant, ppm | | | | | |
|---|---|---|---|---|---|---|
| Warewash Material | 0 | 10 | 20 | 30 | 40 | 50 |
| China Plate | — | — | — | 1 | X | X |
| Glass Slide | — | — | — | 1 | X | X |
| Glass Tumbler | — | — | — | 1 | X | X |

TABLE 9-continued

| Type of Warewash Material | Active Surfactant, ppm 0 | 10 | 20 | 30 | 40 | 50 |
|---|---|---|---|---|---|---|
| Melamine Plate | — | — | — | 1 | X | X |
| Stainless Steel Knife | — | — | — | — | 1 | X |
| Stainless Steel Slide | — | — | — | 1 | X | X |
| Temperature | | 158 | 156 | | | 154 |
| Foam, inches | | ¼ | | ½ | ¾ | ~1" stable foam |

These results indicate that at 50 ppm, formulation E completely sheeted all of the warewash materials. However, about 1 inch of stable foam remained in the machine.

Table 10 illustrates the results of the sheeting evaluation and foam measurement for formulation F.

TABLE 10

| Type of Warewash Material | Active Surfactant, ppm 0 | 10 | 20 | 30 | 40 | 50 |
|---|---|---|---|---|---|---|
| China Plate | — | — | — | 1 | X | X |
| Glass Slide | — | — | — | 1 | X | X |
| Glass Tumbler | — | — | — | 1 | X | X |
| Melamine Plate | — | — | 1 | 1 | X | X |
| Stainless Steel Knife | — | — | — | — | 1 | X |
| Stainless Steel Slide | — | 1 | 1 | 1 | X | X |
| Temperature | | 156 | | 152 | | 150 |
| Foam, inches | | ¼ | | | ½ | ¾" stable foam |

These results indicate that at 50 ppm, formulation F completely sheeted all of the warewash materials. However, ¾ inch of stable foam remained in the machine.

Table 11 illustrates the results of the sheeting evaluation and foam measurement for formulation G.

TABLE 11

| Type of Warewash Material | Active Surfactant, ppm 0 | 10 | 20 | 30 | 40 | 50 | 60 |
|---|---|---|---|---|---|---|---|
| China Plate | — | — | — | — | 1 | 1 | X |
| Glass Slide | — | — | — | — | — | 1 | X |
| Glass Tumbler | — | — | — | — | — | 1 | X |
| Melamine Plate | — | — | — | 1 | 1 | X | X |
| Stainless Steel Knife | — | — | — | — | — | 1 | X |
| Stainless Steel Slide | — | — | — | — | 1 | 1 | X |
| Temperature | 158 | | | 156 | | | 156 |
| Foam, inches | | | | — | — | | Very little |

These results indicate that at 60 ppm, formulation G completely sheeted all of the warewash materials with very little foam (essentially no measurable foam) remaining in the machine.

Table 12 illustrates the results of the sheeting evaluation and foam measurement for formulation H.

TABLE 12

| Type of Warewash Material | Active Surfactant, ppm 0 | 10 | 20 | 30 | 40 | 50 |
|---|---|---|---|---|---|---|
| China Plate | — | — | 1 | X | X | X |
| Glass Slide | — | — | — | — | 1 | X |
| Glass Tumbler | — | — | — | — | 1 | X |
| Melamine Plate | — | — | 1 | X | X | X |

TABLE 12-continued

| Type of Warewash Material | Active Surfactant, ppm 0 | 10 | 20 | 30 | 40 | 50 |
|---|---|---|---|---|---|---|
| Stainless Steel Knife | — | — | — | — | 1 | X |
| Stainless Steel Slide | — | — | — | 1 | 1 | X |
| Temperature | 154 | | | 154 | | 154 |
| Foam, inches | | — | | Some . . . | | ⅛–¼" stable foam |

These results indicate that at 50 ppm, formulation H completely sheeted all of the warewash materials. However, ⅛ to ¼ inch of stable foam remained in the machine. The foam was dense and would not easily break.

Table 13 illustrates the results of the sheeting evaluation and foam measurement for formulation I.

TABLE 13

| Type of Warewash Material | Active Surfactant, ppm 0 | 10 | 20 | 30 | 40 | 50 |
|---|---|---|---|---|---|---|
| China Plate | — | — | — | 1 | X | X |
| Glass Slide | — | — | — | 1 | X | X |
| Glass Tumbler | — | — | — | — | 1 | X |
| Melamine Plate | — | — | — | 1 | X | X |
| Stainless Steel Knife | — | — | — | — | 1 | X |
| Stainless Steel Slide | — | — | — | 1 | 1 | X |
| Temperature | 150 | | | | | 150 |
| Foam, inches | | | ¾ | | | 2" + stable foam |

These results indicate that at 50 ppm, formulation I completely sheeted all of the warewash materials. However, 2 inches of stable foam remained in the machine that splashed onto the warewash materials.

Collectively, the results indicate that formulations A and G provide complete sheeting without the presence of stable foam in the machine after the cycle. However, it should be noted that in formulation A, sheeting did not occur until a level of 70 ppm, while sheeting in formulation G occurred at 60 ppm. Additionally, in formulation A, a capped alcohol alkoxylate (SLF 18B-45) was present as a defoamer, while in formulation G, simple polyoxyethylene block copolymers could be used as defoamers.

Example 5

In this example, solid rinse aid formulation was manufactured and then tested in a number of different water types for sheeting performance and foam formation. The solid rinse aid formulation in this example was made using the components in the weight percents listed in Table 14.

TABLE 14

| Component | Wt- % | General Function of Component |
|---|---|---|
| LD-097[33] | 19.59% | defoamer and sheeting agent |
| Pluronic 25-R-8 Prill[34] | 28.51% | defoamer and sheeting agent |
| Sodium Alkyl Sulfonate[35] | 5.99% | hydrotope |
| Bayhibit S[36] | 6.00% | sequestering agent |
| SXS, 93%[37] | 5.79% | hydrotope |
| NOVEL II 1012-21[38] | 14.62% | sheeting agent |
| Sodium Sulfate, Anhyd Fine Grain | 3.00% | filler |
| PEG 8000[39] | 6.95% | solidifying agent |
| Glutaraldehyde, 50% | 0.87% | preservative |

TABLE 14-continued

| Component | Wt- % | General Function of Component |
|---|---|---|
| PEG 8000[39] | 7.65% | solidifying agent |
| Hydrochloric Acid, 31.5% | 1.03% | pH modifier |

[33]Polyoxypropylene Polyoxyethylene Block copolymer
[34]Polyoxypropylene Polyoxyethylene Block copolymer
[35]Sodium Octyl Sulfonate
[36]2-Phosphonobutane 1,2,4, Tricarboxylic Acid Sodium Salt
[37]Sodium Xylene Sulfonate
[38]Alcohol Ethoxylate $C_{10-12}$, 21Moles Ethylene Oxide, 90% $C_{10}$, 10% $C_{12}$
[39]Polyethylene glycol 8000 mol. wt.

The rinse aid composition was made by combining the above-listed components in a series of processing steps. The first step was to slowly combine the NOVEL II 1012-21, Pluronic 25-R8, SXS, and Peg 8000 while maintaining the temperature at 150° F. This combination was mixed for 30 minutes so that all the components were dissolved. Next, the LD-097 was added and the mixture was mixed 20-30 minutes. The temperature was then allowed to drop naturally. Once the temperature was between 125° F. and 140° F. (but not below 125° F.), the gluteraldehyde was added and the mixture was mixed 20 minutes. The product was then allowed to cool and solidify.

The solid composition was then evaluated in a number of different water types for sheeting performance and foam formation. The evaluation was done using a Champion dish machine and the results are indicated in Tables 15-17. The sheeting test and foam measurement was conducted essentially as described above in Example 4.

Table 15 illustrates the results of the sheeting evaluation and foam measurement for this rinse aid in soft water.

TABLE 15

| | Active Surfactant, ppm | | | | | |
|---|---|---|---|---|---|---|
| Type of Warewash Material | 0 | 20 | 40 | 50 | 60 | 70 |
| China Plate | — | — | 1 | 1 | X | X |
| Glass Slide | — | — | — | 1 | 1 | X |
| Glass Tumbler | — | — | 1 | 1 | 1 | X |
| Melamine Plate | — | — | 1 | 1 | X | X |
| Stainless Steel Knife | — | — | — | — | 1 | X |
| Stainless Steel Slide | — | — | 1 | 1 | X | X |
| Temperature | | 170 | | 166 | | 158 |
| Foam, inches | | | | | | No foam |

Table 16 illustrates the results of the sheeting evaluation and foam measurement for this rinse aid in hot city water.

TABLE 16

| Type of Warewash | Active Surfactant, ppm | | | | | | | | |
|---|---|---|---|---|---|---|---|---|---|
| Material | 0 | 20 | 40 | 50 | 60 | 70 | 80 | 90 | 100 |
| China Plate | — | — | 1 | 1 | X | X | X | X | X |
| Glass Slide | — | — | — | — | — | 1 | 1 | X | X |
| Glass Tumbler | — | — | — | — | — | 1 | 1 | X | X |
| Melamine Plate | — | — | 1 | 1 | X | X | X | X | X |
| Stainless Steel Knife | — | — | — | — | — | 1 | 1 | 1 | X |
| Stainless Steel Slide | — | — | 1 | 1 | 1 | X | X | X | X |
| Temperature | | 170 | | | 162 | | 160 | | 156 |
| Foam, inches | | | | — | | — | | | No foam |

Table 17 illustrates the results of the sheeting evaluation and foam measurement for this rinse aid in hot well water.

TABLE 17

| | Active Surfactant, ppm | | | | | | | |
|---|---|---|---|---|---|---|---|---|
| Type of Warewash Material | 0 | 20 | 40 | 60 | 70 | 80 | 90 | 100 |
| China Plate | — | — | — | 1 | 1 | X | X | X |
| Glass Slide | — | — | — | — | 1 | 1 | 1 | X |
| Glass Tumbler | — | — | — | — | — | — | 1 | X |
| Melamine Plate | — | — | — | 1 | 1 | X | X | X |
| Stainless Steel Knife | — | — | — | — | — | — | 1 | X |
| Stainless Steel Slide | — | — | — | 1 | 1 | 1 | 1 | X |
| Temperature | 166 | | | | | 156 | | 153 |
| Foam, inches | | | | | | | | No foam |

Collectively, the results indicate that this rinse aid provides complete sheeting without the presence of stable foam in the machine after the cycle in soft water, hot city water, and hot well water.

Example 6

In this example, a series of tests were run to compare the foam profiles of several of the raw materials (i.e. sheeting agents and defoamers) by themselves, in certain combinations with each other, and in some instances, in combination with the full formulation as set fourth in Example 3 above. The foam level and foam stability was read after one minute of agitation and again after 5 minutes of agitation. This test was done at 140° F. under 6 atmospheres of pressure in a Glewwe Foam Testing Machine at an Ecolab Inc. facility. Stable foam was defined as foam that remains for several minutes after agitation is stopped. Partially stable foam was defined as foam that breaks slowly within a minute. Unstable foam was defined by foam that breaks rapidly (i.e., breaks in less than 15 seconds). The results of the tests are shown in Table 18.

TABLE 18

| add 50 ppm active | foam after 1 min run time (inches) | | | foam after 5 (total) minutes run time (inches) | |
|---|---|---|---|---|---|
| Component | initial | 15 sec | 1 min | initial | 15 sec |
| Ex. 3[40] | 2 | 0.5 | 0.25 | 3 | 0.75 |
| LD-097[41] | 0 | | | 0 | |
| NOVEL II 1012-21[42] | 8.5 | 8 | 5.5 | 9.5 | 8.5 |
| D-097[43] | 0 | | | 0 | |
| 25% LD-097/75% NOVEL II 1012-21 | 2.5 | 0.5 | 0.25 | 2.5 | 0.5 |
| 25% D-097/75% NOVEL II 1012-21 | 1.5 | trace | trace | 1.5 | trace |
| NOVEL II 1213-21[44] | 9 | 8.5 | 7.5 | 9 | 8.5 |
| NOVEL II 1214-23[45] | 9.5 | 9.5 | 9 | 10 | 9.5 |
| NOVEL II 1214-30[46] | 9.5 | 9 | 8.5 | 9.5 | 9 |
| The formulation from Example 3 (using NOVEL II 1012-21) | 2 | 0.5 | 0.25 | 2.5 | 0.5 |
| The formulation from Example 3, but replacing the NOVEL II 1012-2 with NOVEL II 1213-21 | 9 | 8.5 | 7 | 9.5 | 9 |
| The formulation from Example 3, but replacing the NOVEL II 1012-2 with NOVEL II 1214-23 | 10 | 8.5 | 7.5 | 11 | 9.5 |

TABLE 18-continued

| add 50 ppm active | foam after 1 min run time (inches) | | | foam after 5 (total) minutes run time (inches) | |
|---|---|---|---|---|---|
| Component | initial | 15 sec | 1 min | initial | 15 sec |
| The formulation from Example 3, but replacing the NOVEL II 1012-2 with NOVEL II 1214-30 | 9.5 | 9 | 7.5 | 9.5 | 9 |

[40]The solid rinse aid as described in Example 3.
[41]Polyoxypropylene Polyoxyethylene Block copolymer
[42]Alcohol Ethoxylate $C_{10-12}$, 21 Moles Ethylene Oxide, 90% $C_{10}$, 10% $C_{12}$
[43]Polyoxypropylene Polyoxyethylene Block copolymer
[44]Alcohol Ethoxylate Branched $C_{12-13}$, 21Moles Ethylene Oxide
[45]Alcohol Ethoxylate $C_{12-14}$, 23 Moles Ethylene Oxide, 70% $C_{12}$, 30% $C_{14}$
[46]Alcohol Ethoxylate $C_{12-14}$, 30 Moles Ethylene Oxide, 70% $C_{12}$, 30% $C_{14}$ The results of this test indicate that the best foam profiles (i.e., profiles with the least amount of stable foam) are seen with the LD-097, D-097 defoamers, the combination of 25% LD-097 defoamer with 75% NOVEL II 1012-21 sheeting agent, the combination of 25% D-097 defoamer with 75% NOVEL II 1012-21 sheeting agent, and the formulation from Example 3 using NOVEL II 1012-21.

Additionally, NOVEL II 1213-21 sheeting agent and LD-097 defoamer were tested alone for sheeting ability in the manner described above in Example 4. The results of the tests for the NOVEL II 1213-21 are shown in Table 19, and the results of the tests of the LD-097 are shown in Table 20.

TABLE 19

| | Active Surfactant, ppm | | | |
|---|---|---|---|---|
| Type of Warewash Material | 0 | 40 | 50 | 60 |
| China Plate | – | S | + | Too foamy |
| Glass Slide | – | 1 | 1 | Too foamy |
| Glass Tumbler | – | S | + | Too foamy |
| Melamine Plate | – | + | + | Too foamy |
| Stainless Steel Knife | – | S | 1 | Too foamy |
| Stainless Steel Slide | – | 1 | 1 | Too foamy |
| Temperature, ° F. | 160 | 160 | 160 | 160 |
| Suds, inches | 0 | 5 | 5.5 | 5.5 |

TABLE 20

| | Active Surfactant, ppm | | | | | |
|---|---|---|---|---|---|---|
| Type of Warewash Material | 0 | 40 | 50 | 60 | 70 | 80 |
| China Plate | – | 1 | 1 | 1 | + | + |
| Glass Slide | – | 1 | 1 | 1 | 1 | + |
| Glass Tumbler | – | 1 | 1 | 1 | 1 | + |
| Melamine Plate | – | 1 | 1 | 1 | + | + |
| Stainless Steel Knife | – | 1 | 1 | 1 | 1 | + |
| Stainless Steel Slide | – | 1 | 1 | 1 | + | + |
| Temperature, ° F. | 160 | 160 | 160 | 160 | 160 | 160 |
| Suds, inches | 0 | 0 | 0 | 0 | 0 | 0 |

These results indicate that NOVEL II 1213-21 results in a great amount of foam when used alone. These results also indicate that at 80 ppm, LD-097 completely sheeted all of the warewash materials with no measurable foam remaining in the machine.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A rinse aid composition comprising:

a sheeting component comprising about 50 weight percent or more of a first compound and about 50 weight percent or less of a second compound different from the first compound, the first and second compounds each independently having structure represented by formula I:

$$R—O—(CH_2CH_2O)_n—H \quad (I)$$

wherein R is a ($C_1$-$C_{12}$) alkyl group, and n is an integer in the range of 10 to 50; and a defoamer component comprising a polymer compound including one or more ethylene oxide groups and one or more propylene oxide groups.

2. The rinse aid composition of claim 1, wherein for the first compound, R is a ($C_1$-$C_{10}$) alkyl group.

3. The rinse aid composition of claim 1, wherein for the first compound, r is a ($C_8$-$C_{10}$) alkyl group.

4. The rinse aid composition of claim 1, wherein for the second compound, R is a ($C_{10}$-$C_{12}$) alkyl group.

5. The rinse aid composition of claim 1, wherein for the first compound, R is a $C_{10}$ alkyl group.

6. The rinse aid composition of claim 1, wherein for the second compound, R is a $C_{12}$ alkly group.

7. The rinse aid composition of claim 1, wherein for the first compound, R is a $C_{10}$ alkyl group, and the for the second compound, R is a $C_{12}$ alkyl group.

8. The rinse aid composition of claim 1, wherein n is an integer in the range of 15 to 30.

9. The rinse aid composition of claim 1, wherein n is 21.

10. The rinse aid composition of claim 1, wherein the sheeting component includes in the range of about 75 weight percent or more of the first compound, and in the range of about 25 weight percent or less of the second compound.

11. The rinse aid composition of claim 1, wherein the sheeting component includes in the range of about 85 weight percent or more of the first compound, and in the range of about 15 weight percent or less of the second compound.

12. The rinse aid composition of claim 1, wherein the mole ratio of the first compound to the second compound is in the range of about 3:1 to about 9:1.

13. The rinse aid of claim 7, wherein the sheeting component includes in the range of about 75 weight percent or more of the first compound, and in the range of about 25 weight percent or less of the second compound.

14. The rinse aid composition of claim 1, wherein the defoamer exhibits a cloud point.

15. The rinse aid composition of claim 1, wherein the defoamer exhibits a cloud point in the range of about 40° C. or higher.

16. The rinse aid composition of claim 1, wherein the defoamer exhibits a cloud point in the range of about 60° C. or higher.

17. The rinse aid composition of claim 1, wherein the defoamer exhibits a cloud point in the range of about 80° C. or higher.

18. The rinse aid of claim 1, wherein the defoamer comprises a polyoxypropylene-polyoxyethylene block copolymer surfactant.

19. The rinse aid of claim 1, wherein the ratio, by weight, of the sheeting component to the defoamer component within the rinse aid composition is in the range of about 1:5 to about 5:1.

20. A rinse aid composition comprising:

a sheeting component including about 50 weight percent or more of a first compound and about 50 weight percent or less of a second compound, wherein each of the first compound and the second compound has a structure represented by formula (I):

$$R—O—(CH_2CH_2O)_n—H \quad (I)$$

wherein R is a ($C_1$-$C_{12}$) alkyl group, wherein n is an integer in the range of about 10 to about 50; and a defoamer component comprising an ethylene oxide containing polymer that exhibits a cloud point; and wherein, when the rinse aid is mixed into an aqueous use solution at a temperature at or above the cloud point, the defoamer component is configured to interact with the sheeting component to reduce the amount of stable foam produced by the sheeting component within the use solution.

21. The rinse aid composition of claim 20, wherein the first compound is represented by formula (I) in which R is a ($C_8$-$C_{10}$) alkyl group, and the second compound is represented by formula (I) in which R is a ($C_{10}$-$C_{12}$) alkyl group.

22. The rinse aid composition of claim 21, wherein for the first compound, R is a $C_{10}$ alkyl group, and wherein for the second compound, R is a $C_{12}$ alkyl group.

23. The rinse aid composition of claim 21, wherein the sheeting component includes in the range of about 75 weight percent or more of the first compound, and in the range of about 25 weight percent or less of the second compound.

24. The rinse aid composition of claim 20, wherein the defoamer component includes a polyether compound prepared from ethylene oxide, propylene oxide, or a mixture thereof.

25. The rinse aid composition of claim 20, wherein the defoamer exhibits a cloud point in the range of about 40° C. or higher.

26. The rinse aid of claim 20, wherein the defoamer is an ethylene oxide and propylene oxide co-polymer.

27. The rinse aid composition of claim 20, wherein the defoamer comprises a polyoxypropylene-polyoxyethylene block copolymer surfactant.

28. The rinse aid composition of claim 21, wherein the ratio of sheeting component to defoamer component to defoamer component within the rinse aid composition is in the range of about 1:5 to about 5:1 (by wt.).

29. A rinse aid composition comprising:

a sheeting component including a first compound and a second compound different from the first compound, the first compound having the formula $R—O—(CH_2CH_2O)_n—H$, wherein R is a ($C_1$-$C_{11}$) alkyl group, and n is an integer in the range of 10 and 50, the second compound having the formula $R_1—O—(CH_2CH_2O)_m—H$, wherein $R_1$ is a ($C_1$-$C_{13}$) alkyl group, and m is an integer in the range of 10 and 50;

wherein the sheeting component includes about 50 weight percent or more of the first compound and about 50 weight percent or less of the second compound; and a defoamer component comprising a polymer compound including one or more ethylene oxide groups, the defoamer component being configured for reducing the stability of foam that is created by the sheeting component in an aqueous use solution.

30. The rinse aid composition of claim 29, wherein the defoamer contains ethylene oxide groups.

31. The rinse aid of claim 29, wherein R is a ($C_8$-$C_{10}$) alkyl group.

32. The rinse aid of claim 29, wherein $R_1$ is a ($C_{10}$-$C_{12}$) alkyl group.

33. The rinse aid of claim 29, wherein the sheeting component includes about 75 weight percent or more of the first molecule and about 25 weight percent or less of the second molecule.

34. The rinse aid of claim 29, wherein the sheeting component includes about 85 weight percent or more of the first molecule and about 15 weight percent or less of the second molecule.

35. A method of making a rinse aid composition, the method comprising:

providing a sheeting component including about 50 weight percent or more of a first compound and about 50 weight percent or less of a second compound different from the first compound, each the first and second compounds having structure represented by the formula $R—O—(CH_2CH_2O)_n—H$, wherein R is a ($C_1$-$C_{12}$) alkyl group, and n is an integer in the range of 10 to 50;

providing a defoamer component including a compound containing ethylene oxide groups and propylene oxide groups; and mixing the sheeting component with the defoamer component to form the rinse aid composition.

36. The method of claim 35, wherein for the first compound R is a ($C_1$-$C_{10}$) alkyl group.

37. The method of claim 35, wherein for the second compound, R is a ($C_{10}$-$C_{12}$) alkyl group.

38. The method of claim 35, wherein the sheeting component includes in the range of about 70 weight percent or more of the first compound, and in the range of about 30 weight percent or less of the second compound.

39. The method of claim 35, wherein the step of mixing the sheeting compound with the defoamer component includes extrusion.

40. A method for rinsing ware in a warewashing application, the method comprising the steps of:

providing a rinse aid composition, the rinse aid composition including a sheeting component including about 50 weight percent or more of a first compound and about 50 weight percent or more of a second compound different from the first compound, each the first and second compounds having structure represented by the formula $R—O—(CH_2CH_2O)_n—H$, wherein R is a ($C_1$-$C_{12}$) alkyl group, and n is an integer in the range of 10 to 50, and a defoamer component including a compound containing ethylene oxide groups and propylene oxide groups;

mixing the rinse aid composition into an aqueous use solution; and applying the aqueous use solution to the ware.

41. The method of claim 40, wherein the first compound, R is a ($C_1$-$C_{10}$) alkyl group.

42. The method of claim 40, wherein for the second compound, R is a ($C_{10}$-$C_{12}$) alkyl group.

43. The method of claim 40, wherein the sheeting component includes in the range of about 70 weight percent or more of the first compound, and in the range of about 30 weight percent or less of the second compound.

* * * * *

UNITED STATES PATENT AND TRADEMARK OFFICE

CERTIFICATE OF CORRECTION

PATENT NO. : 7,279,455 B2
APPLICATION NO. : 10/703042
DATED : October 9, 2007
INVENTOR(S) : Kieffer et al.

It is certified that error appears in the above-identified patent and that said Letters Patent is hereby corrected as shown below:

On the title page, item [54] under title:
delete "OF RISING A SUBSTRATE",
insert --OF RINSING A SUBSTRATE--

Col. 1, line 2,
delete "OF RISING A SUBSTRATE",
insert --OF RINSING A SUBSTRATE--

Col. 2, line 5,
delete "rise aid composition",
insert --rinse aid composition--

Col. 2, line 30,
delete "few carbon atoms",
insert --fewer carbon atoms--

Col. 6, line 48,
delete "the intended sue",
insert --the intended use--

Col. 9, lines 21 & 22,
delete "m-
ethylenephosphonic",
insert --methylenephosphonic-- (Please do not split the word after the m)

Col. 17, line 4,
delete "begins to hardens",
insert --begins to harden--

Col. 19, line 11,
delete "pans, tray, pitchers,"
insert --pans, trays, pitchers--

Col. 19, line 12,
delete "knives, spoons, . spatulas"
insert --knives, spoons, spatulas--

Col. 19, line 39,
delete "listed Table"
insert --listed in Table--

UNITED STATES PATENT AND TRADEMARK OFFICE

CERTIFICATE OF CORRECTION

PATENT NO. : 7,279,455 B2
APPLICATION NO. : 10/703042
DATED : October 9, 2007
INVENTOR(S) : Kieffer et al.

It is certified that error appears in the above-identified patent and that said Letters Patent is hereby corrected as shown below:

Col. 21, line 6,
delete "Peg",
insert --PEG--

Col. 21, line 19,
delete "Peg",
insert --PEG--

Col. 27, line 18,
delete "and Peg 8000"
insert --and PEG 8000--

Signed and Sealed this

Fifteenth Day of July, 2008

JON W. DUDAS
*Director of the United States Patent and Trademark Office*